US012246912B1

(12) United States Patent
Ramsey et al.

(10) Patent No.: US 12,246,912 B1
(45) Date of Patent: Mar. 11, 2025

(54) COLLAPSIBLE BULK CONTAINER

(71) Applicant: U.S. Development Corp., Kent, OH (US)

(72) Inventors: Jerold Patrick Ramsey, Tallmadge, OH (US); Larry Michael Downey, Hartville, OH (US); James Jacob Carmon, Columbus, OH (US)

(73) Assignee: U.S. Development Corp., Kent, OH (US)

( * ) Notice: Subject to any disclaimer, the term of this patent is extended or adjusted under 35 U.S.C. 154(b) by 0 days.

(21) Appl. No.: 18/793,134

(22) Filed: Aug. 2, 2024

(51) Int. Cl.
*B65D 88/52* (2006.01)
*B65D 90/00* (2006.01)
*B65D 90/12* (2006.01)

(52) U.S. Cl.
CPC ..... *B65D 88/522* (2013.01); *B65D 90/008* (2013.01); *B65D 90/12* (2013.01)

(58) Field of Classification Search
CPC .... B65D 88/522; B65D 90/008; B65D 90/12; B65D 1/225; B65D 5/36; B65D 5/3621; B65D 5/3628; B65D 5/3678; B65D 7/24; B65D 7/30; B65D 5/00
See application file for complete search history.

(56) References Cited

U.S. PATENT DOCUMENTS 3,156,370 A 11/1964 Grant
3,474,901 A 10/1969 Viater
3,957,179 A 5/1976 Bamburg
5,971,187 A * 10/1999 Clee ..... B65D 11/18 16/382
6,460,724 B1 10/2002 Bradford
7,328,833 B1 2/2008 Wiley
8,408,411 B2 4/2013 Hay
8,770,421 B2 7/2014 Hay
8,807,366 B2 * 8/2014 Erm ..... B65D 19/18 220/666
9,694,934 B2 7/2017 Olds
2005/0196080 A1 9/2005 Stone
2006/0169690 A1 * 8/2006 Rothschild ..... A47G 9/062 220/7
2011/0017731 A1 * 1/2011 Taravella ..... B65D 77/061 220/4.28
2012/0152799 A1 6/2012 Ficker
2013/0228583 A1 * 9/2013 Mayer ..... B65D 81/3862 220/666
2015/0083715 A1 3/2015 Shuert

* cited by examiner

*Primary Examiner* — Kareen K Thomas
(74) *Attorney, Agent, or Firm* — Renner, Kenner, Greive, Bobak, Taylor & Weber

(57) ABSTRACT

A collapsible container including a plurality of panels including an opposing pair of corner panels, an opposing pair of dogleg panels, a front panel opposed from a back panel, and an opposing pair of side panels, wherein each of the front panel, the back panel, and the opposing pair of side panels are pivotally connected to one corner panel of the opposing pair of corner panels and one dogleg panel of the opposing pair of dogleg corner panels, and wherein the collapsible container has an erected configuration and a collapsed configuration.

20 Claims, 17 Drawing Sheets

COLLAPSIBLE BULK CONTAINER

FIELD OF THE INVENTION

The present invention relates generally to bulk containers, and more particularly bulk containers which are adapted to collapse into flatly stackable and storable configurations when not in use.

BACKGROUND OF THE INVENTION

Processes that utilize materials provided in powdered, pelletized, and other loose forms are often provided in bulk quantities not readily usable in manufacturing or other environments without dedicated material handling infrastructure. For example, loose materials may arrive at a manufacturing site via rail car and must be placed in an intermediate container for use. In other examples, loose materials are provided in soft-sided or minimally structured bags that cannot be safely opened for use without creating hazards relating to spilling of the loose materials. In response, processes that rely on the utilization of loose materials have employed containers made from materials such as cardboard, wood, and metal to improve material handling. These containers may be permanent rigid structures, one-time use, or capable of being assembled for use and disassembled for storage. In some instances, these containers, once erected, are not able to be collapsed for convenient storage, or are heavy and unwieldly to collapse for storage. In other instances, the containers lack the requisite strength to be stacked or on top of other containers.

Thus, there is a need for an improved container for containing loose materials that is readily convertible between collapsed and erected configurations and easily storable in the collapsed configuration.

SUMMARY OF THE INVENTION

An embodiment of the present invention provides a collapsible container comprising a plurality of panels including an opposing pair of corner panels, an opposing pair of dogleg panels, a front panel opposed from a back panel and an opposing pair of side panels, wherein each of the front panel, the back panel, and the opposing pair of side panels are pivotally connected to one corner panel of the opposing pair of corner panels and one dogleg panel of the opposing pair of dogleg corner panels, and wherein the collapsible container has an erected configuration and a collapsed configuration.

Another embodiment of the present invention provides a collapsible container as in any embodiment above, wherein the opposing pair of corner panels, the opposing pair of dogleg panels, the front panel, the back panel, and the opposing pair of side panels form a plurality of sidewalls of the collapsible container in the erected configuration, and wherein, when the plurality of sidewalls are oriented generally upwardly from a surface, the plurality of sidewalls and said surface define a container volume.

Another embodiment of the present invention provides a collapsible container as in any embodiment above, wherein the surface is provided by a pallet, wherein the pallet provides a bottom surface having slots.

Another embodiment of the present invention provides a collapsible container as in any embodiment above, wherein a bottom surface insert is placed on the surface to form a continuous surface over the pallet.

Another embodiment of the present invention provides a collapsible container as in any embodiment above, wherein when the collapsible container is in the erected configuration the front panel forms a first plane that is parallel to a second plane formed by the back panel, wherein a third plane and a fourth plane are formed by each one of the opposing pair of side panels, wherein the third plane is parallel to the fourth plane, and wherein the first plane and second plane are perpendicular to the third plane and fourth plane.

Another embodiment of the present invention provides a collapsible container as in any embodiment above, wherein when the collapsible container is in the collapsed configuration a first fold-flat layer and a second fold-flat layer are formed, and wherein the first fold-flat layer and the second fold-flat layer are positioned such that a footprint of the collapsible container in the collapsed configuration is substantially the same as a footprint of the first fold-flat layer and a footprint of the second fold-flat layer.

Another embodiment of the present invention provides a collapsible container as in any embodiment above, wherein the first fold-flat layer and the second fold-flat layer are joined at opposing ends by the opposing pair of dogleg panels.

Another embodiment of the present invention provides a collapsible container as in any embodiment above, wherein the first fold-flat layer comprises one dogleg panel of the opposing pair of dogleg panels, one side panel of the opposing pair of side panels, one corner panel of the opposing pair of corner panels, the front panel, and an offset hinge portion of the other dogleg panel of the opposing pair of dogleg panels.

Another embodiment of the present invention provides a collapsible container as in any embodiment above, wherein the second fold-flat layer comprises the other dogleg panel of the opposing pair of dogleg panels, the other side panel of the opposing pair of side panels, the other corner panel of the opposing pair of corner panels, the back panel, and an offset hinge portion of the one dogleg panel of the opposing pair of dogleg panels.

Another embodiment of the present invention provides a collapsible container as in any embodiment above, wherein the pivotal connection between each panel of the plurality of panels is a hinged connection.

Another embodiment of the present invention provides a collapsible container as in any embodiment above, wherein the hinged connection provides for continuous connection between the plurality of panels when changing the collapsible container between the erected configuration and the collapsed configuration.

Another embodiment of the present invention provides a collapsible container as in any embodiment above, wherein the hinged connection comprises a pin within a bore of one or more female hinge portions of each panel of the plurality of panels.

Another embodiment of the present invention provides a collapsible container as in any embodiment above, wherein the one or more female hinge portions are located on opposing edges of each panel of the plurality of panels.

Another embodiment of the present invention provides a collapsible container as in any embodiment above, wherein the offset hinge portion of each dogleg panel of the opposing pair of dogleg panels is configured to accommodate a thickness of the first fold-flat layer and a thickness of the second fold-flat layer.

Another embodiment of the present invention provides a collapsible container as in any embodiment above, the collapsible container further comprising a plurality of bottom perimeter flaps, and wherein one of the plurality of bottom perimeter flaps is pivotably connected to each of the front panel, the back panel, and the opposing pair of side panels.

Another embodiment of the present invention provides a collapsible container as in any embodiment above, wherein when the collapsible container is in the erected configuration the plurality of bottom perimeter flaps is pivoted to be perpendicular to the plurality of panels.

Another embodiment of the present invention provides a collapsible container as in any embodiment above, wherein each bottom perimeter flap of the plurality of bottom perimeter flaps is configured to provide an interference fit with one or more adjacent bottom perimeter flaps in the erected configuration.

Another embodiment of the present invention provides a collapsible container as in any embodiment above, wherein each bottom perimeter flap of the plurality of bottom perimeter flaps is configured to be coplanar with each panel of the plurality of panels the bottom perimeter flap is pivotally connected to when the collapsible container is in the collapsed configuration.

Another embodiment of the present invention provides a collapsible container as in any embodiment above, wherein the plurality of bottom perimeter flaps comprises a front panel bottom perimeter flap pivotally connected to the front panel, a back panel bottom perimeter flap pivotally connected to the front panel, a pair of side panel bottom perimeter flaps pivotally, one of each of the pair of side panel bottom perimeter flaps connected to one of each side panel of the opposing pair of side panels.

Another embodiment of the present invention provides a collapsible container as in any embodiment above, wherein the front panel comprises a front panel door and a front panel door latch.

Another embodiment of the present invention provides a collapsible container as in any embodiment above, wherein any panel of the plurality of panels includes a plurality of protrusions on a surface of the panel configured to engage with a corresponding plurality of indentations on a surface of a different panel in the collapsed position.

Another embodiment of the present invention provides a collapsible container as in any embodiment above, wherein any panel of the plurality of panels includes one or more cut-outs at a portion of a top perimeter thereof.

Another embodiment of the present invention provides a collapsible container as in any embodiment above, wherein when the collapsible container is in a collapsed configuration one or more cut-outs are in a first fold-flat layer and overlap with a non-cut-off portion of panels in a second fold-flat layer.

Another embodiment of the present invention provides a collapsible container as in any embodiment above, wherein any panel of the plurality of panels includes viewing ports for seeing the container volume.

Another embodiment of the present invention provides a collapsible container as in any embodiment above, wherein the opposing pair of side panels comprise recesses for an optional lid.

Another embodiment of the present invention provides a collapsible container as in any embodiment above, wherein a bottom edge of each panel of the plurality of panels is configured to securely engage a pallet in the erected configuration.

DETAILED DESCRIPTION OF ILLUSTRATIVE EMBODIMENTS

Figure 1:
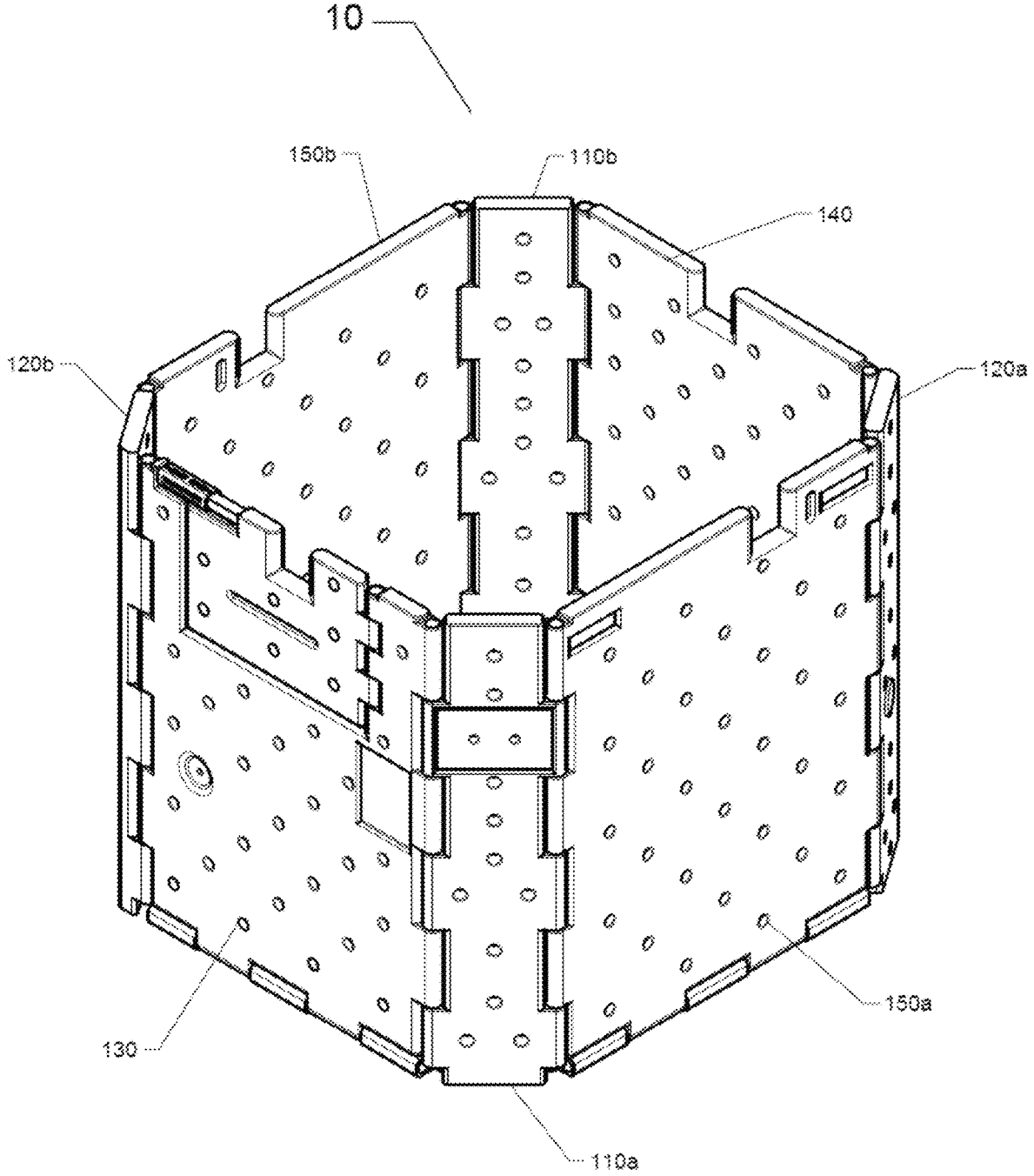
FIG. 1 is a perspective view of an erected collapsible container according to an embodiment of the present invention.

With reference to FIGS. 1-14, an exemplary embodiment of the present invention including a collapsible container 10 is shown. In FIG. 1 collapsible container 10 is shown in an erected configuration and includes plurality of panels 100 comprising opposing pair of corner panels 110*a*, 110*b*, opposing pair of dogleg panels 120*a*, 120*b*, front panel 130, back panel 140, and opposing pair of side panels 150*a*, 150*b*. The plurality of panels 100 form a plurality of sidewalls when collapsible container 10 is an erected state, as shown in FIG. 1. Each panel of the plurality of panels are pivotally connected to at least two other panels. As shown in FIG. 1, each of front panel 130, back panel 140, and side panels 150*a*, 150*b* are pivotally connected to one dogleg panel of opposing pair of dogleg panels 120*a*, 120*b* and one corner panel of opposing pair of corner panels 110*a*, 110*b*.

Figure 2:
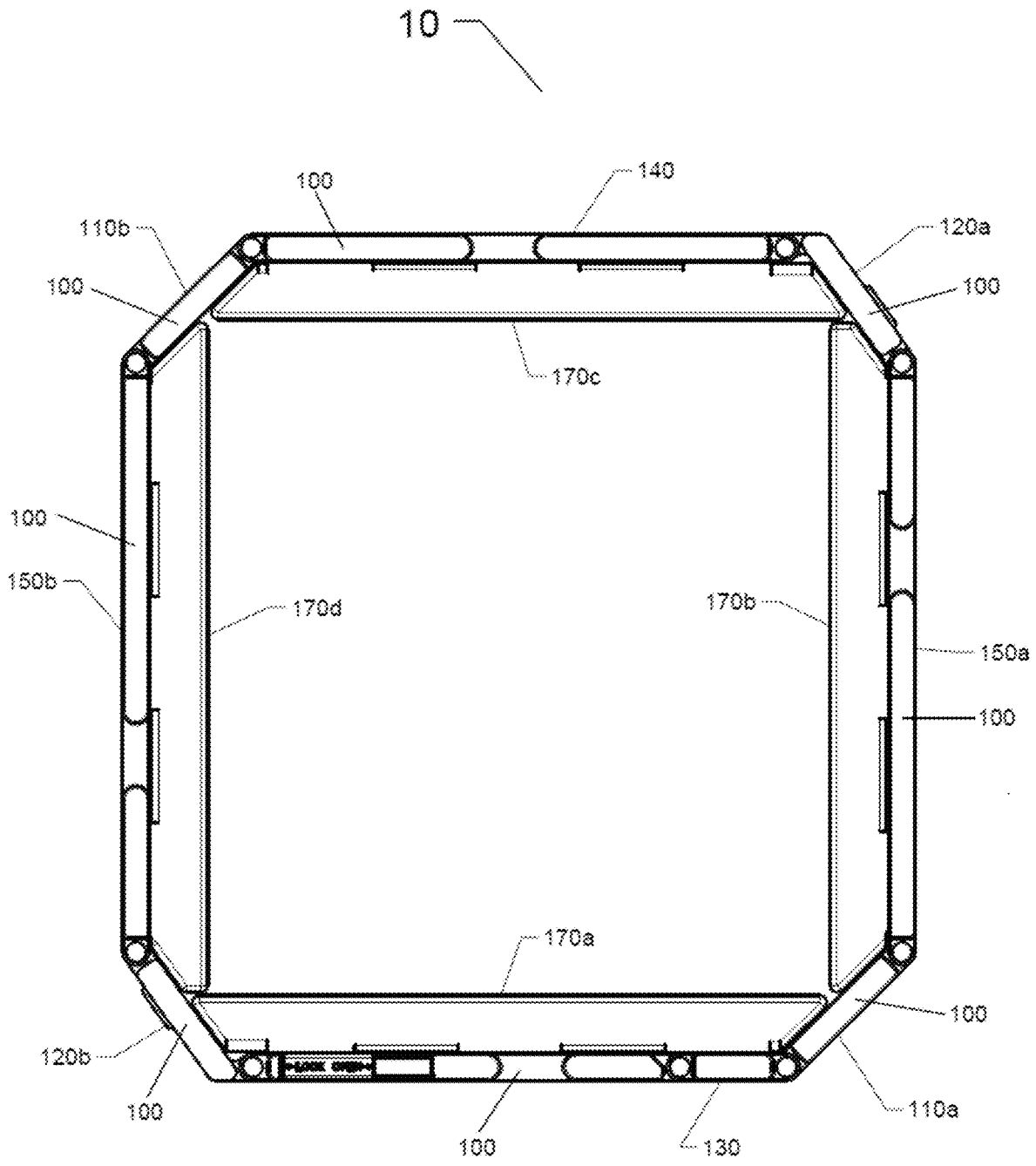
FIG. 2 is a top-down plan view of an erected collapsible container according to an embodiment of the present invention.

As shown in FIGS. 2 and 3, plurality of panels 100 form a perimeter of a plurality of sidewalls 20 as seen in the top-down view of collapsible container 10 in an erected configuration. Plurality of sidewalls 20 are oriented generally upwardly from surface 30. Plurality of sidewalls 20 in combination with surface 30 define container volume 200 of collapsible container 10.

In some embodiments collapsible containers according to the present invention receive materials for storage within the container volume. In these and other embodiments, the collapsible container may first receive a bag or liner prior to receiving materials for storage within the container volume. Bags or liners suitable for use with the present invention may include those comprising fabric, plastics, etc. Materials suitable for use with the present invention broadly include any material needing storage within a rigid container, especially loose materials. Loose materials may include powders, pellets, sand, gravel, resins, and other bulk materials. Embodiments of the present invention are particularly well suited for manufacturing environments where loose materials are used as intermediates in the production of products. Collapsible containers according to the present invention advantageously provide a rigid container for materials that are traditionally loose and improves the ability to handle said materials as part of a process.

Figure 3A:
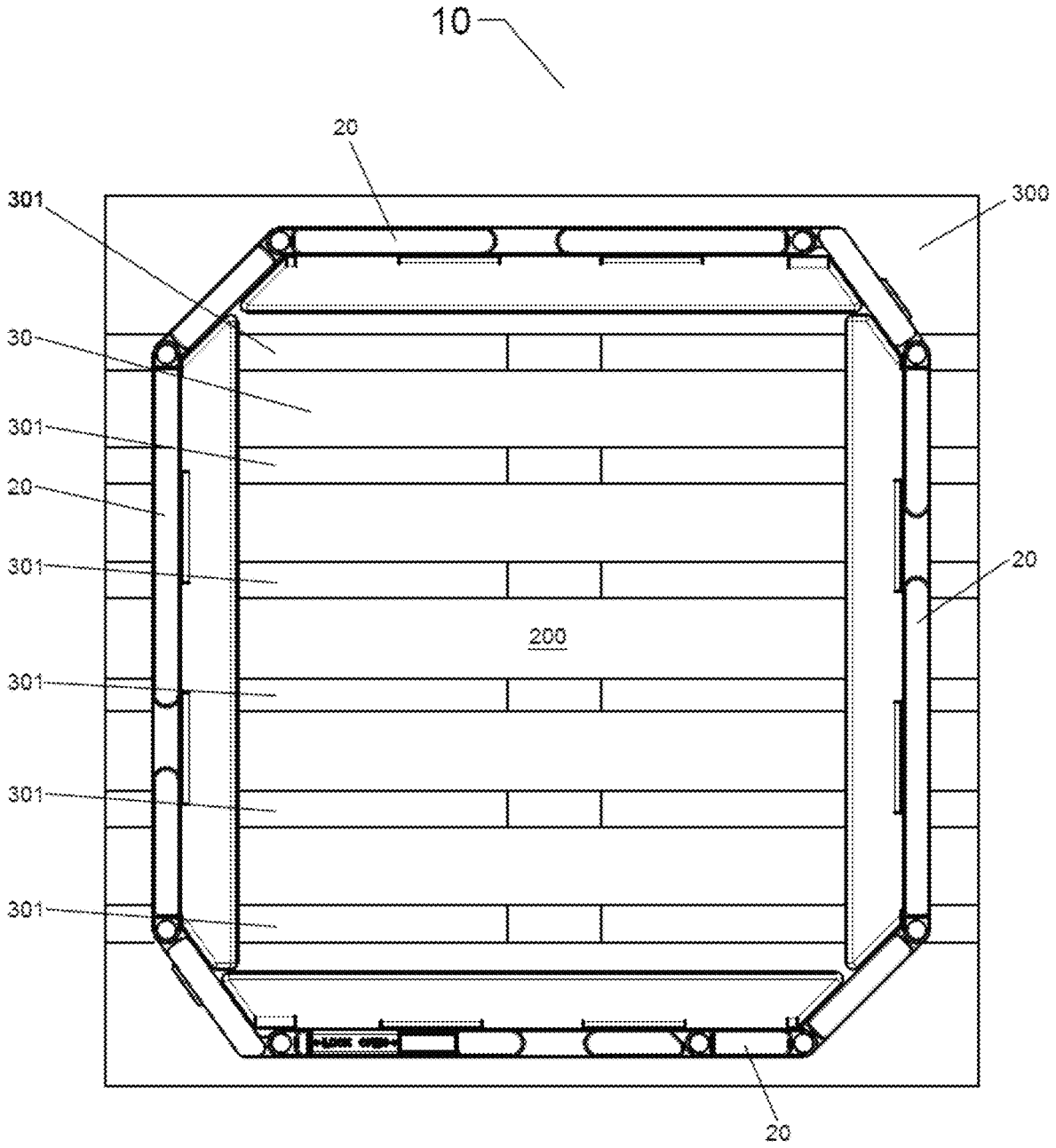
FIG. 3A is a top-down plan view of an erected collapsible container according to an embodiment of the present invention.
Figure 3B:
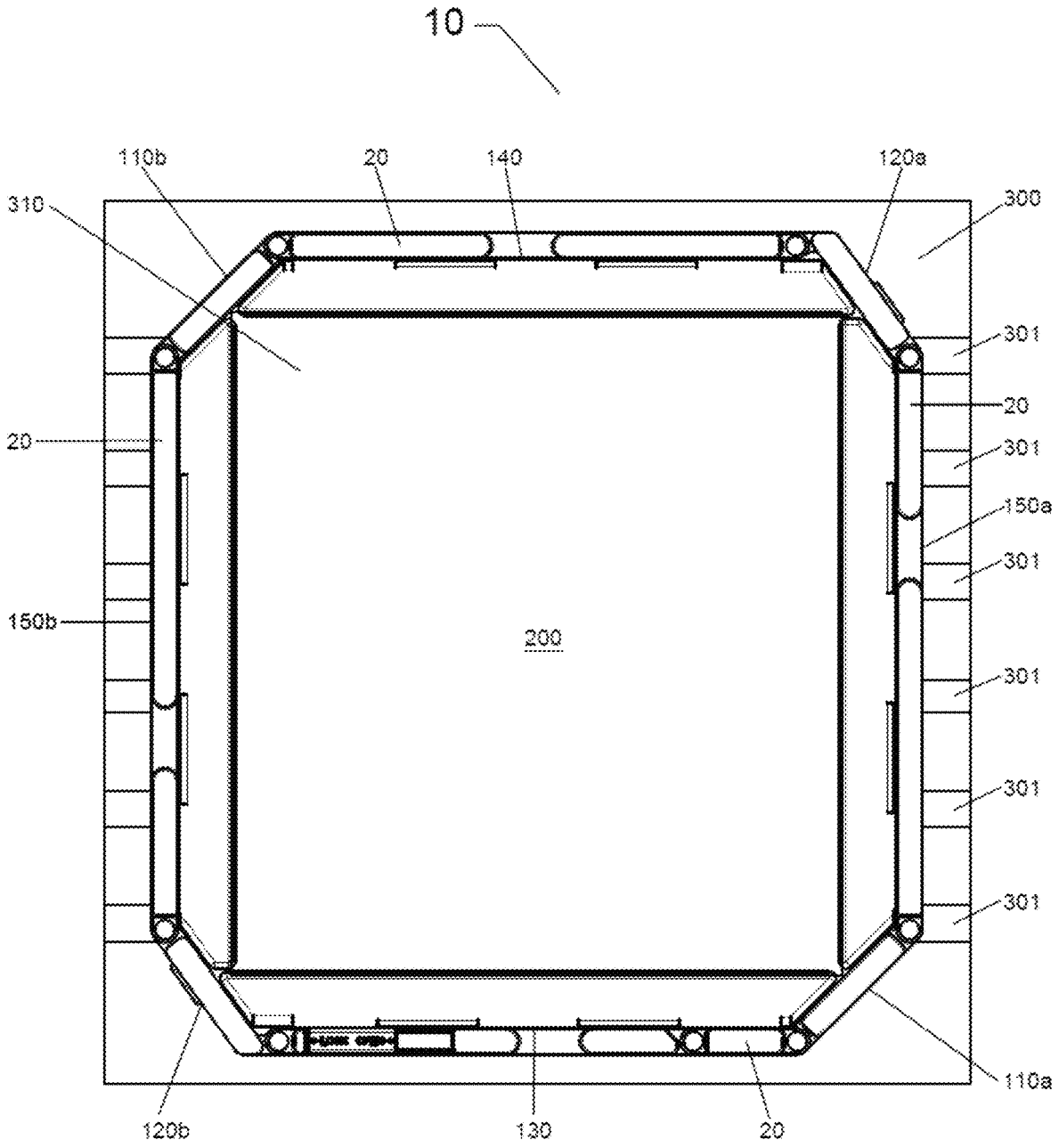
FIG. 3B is a top-down plan view of an erected collapsible container according to an embodiment of the present invention.

In some embodiments, surfaces upon which collapsible containers may be used includes pallets, shelving, and any other generally flat surface capable of supporting the load of material contained therein. In instances where the surface is not continuous and materials may fall through, a bottom surface insert may be present. As shown in FIG. 3A, collapsible container 10 is erected upon pallet 300 which forms surface 30. Pallet 300 includes slots 301 in surface 30 through which materials may fall through. As shown in FIG. 3B, bottom surface insert 310 is used to provide a continuous surface to hold materials. Bottom surface inserts suitable for use with the present invention may be generally described as thin and planar bodies to rest at the bottom of collapsible containers. Bottom surface inserts may comprise cardboard, wood, plastic, and other suitable materials. Bottom surface inserts may further include features for easily removing the insert when collapsing a collapsible container according to embodiment of the present invention. Features for removing bottom surface inserts may include handles, including rigid handles or soft handles secured to the insert.

Figure 4:
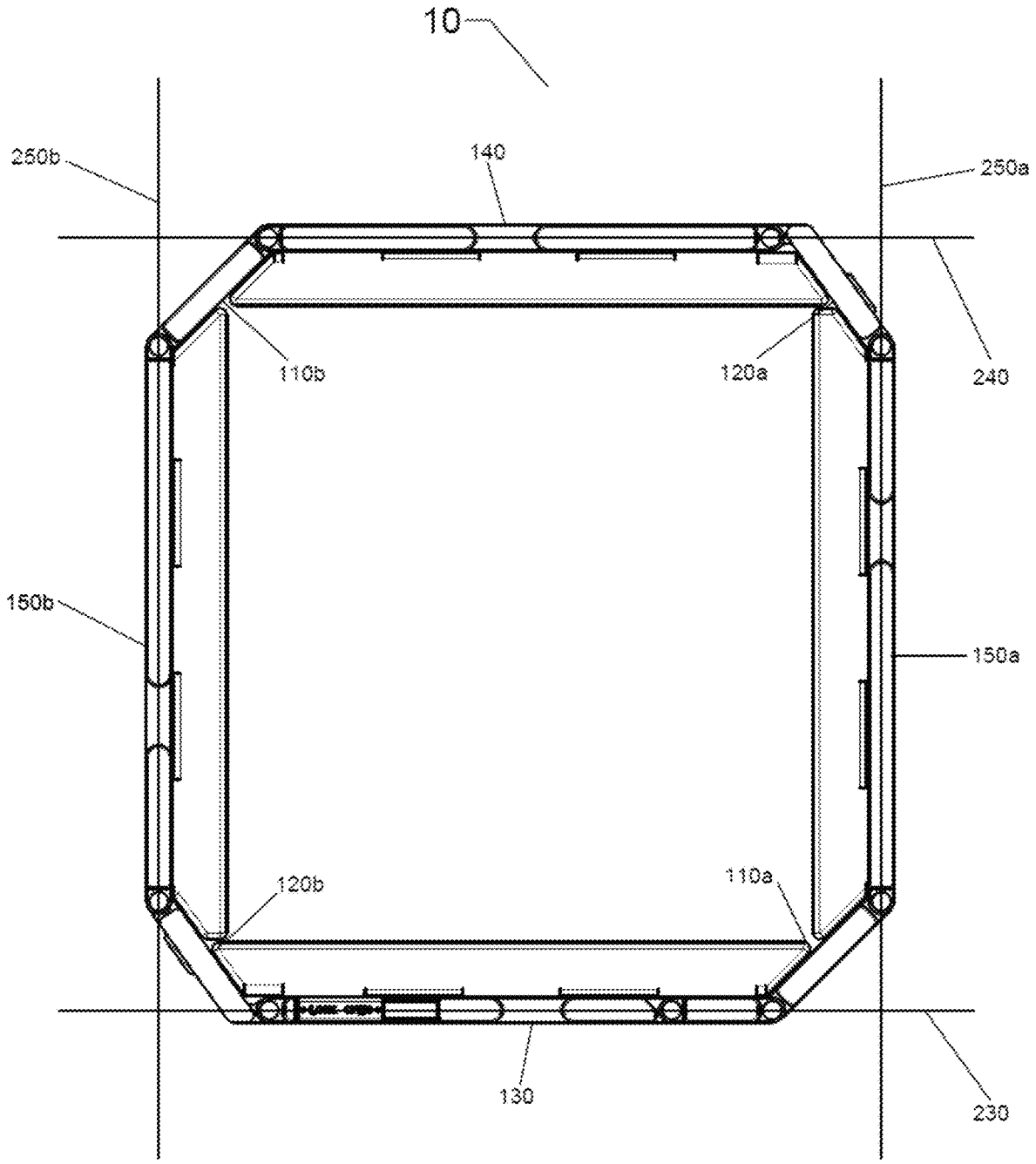
FIG. 4 is a top-down plan view of an erected collapsible container according to an embodiment of the present invention.

As shown in FIG. 4, collapsible container 10 in the erected configuration may described according to planes formed by each panel of the plurality of panels 20. Front panel 130 forms first plane 230 that is parallel to second plane 240 formed by back panel 140. Third plane 250*a* and fourth plane 250*b* are formed by each one of the opposing pair of side panels 150*a*, 150*b*. Third plane 250*a* is parallel to fourth plane 250*b*. First plane 230 and second plane 240 are perpendicular to third plane 250*a* and fourth plane 250*b*. Accordingly, collapsible container 10 has a generally quadrilateral shape making it well suited for use with pallets for improved material handling of loose materials.

Figure 5:
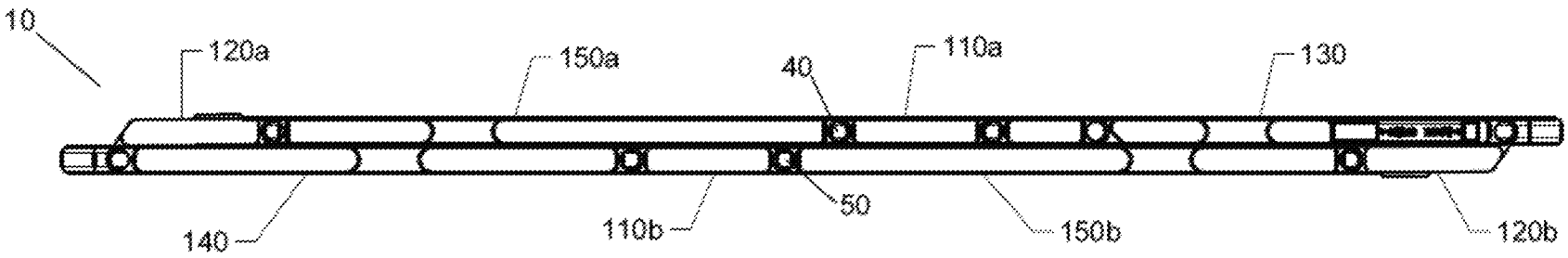
FIG. 5 is an elevation view of a collapsible container in a collapsed configuration according to an embodiment of the present invention.
Figure 6:
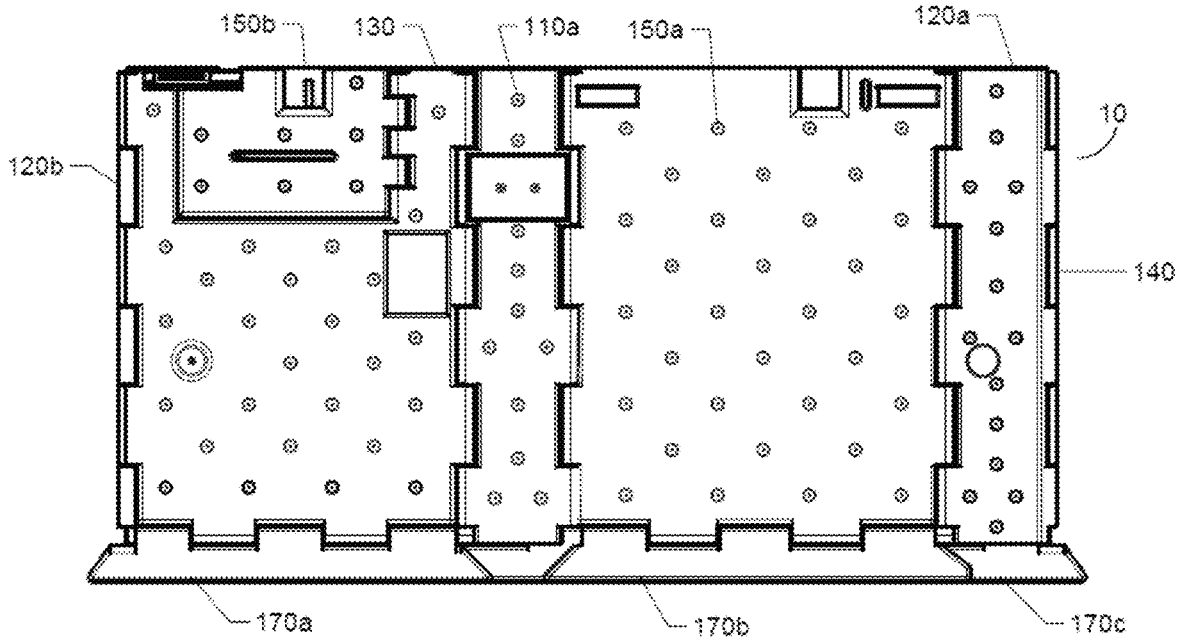
FIG. 6 is a plan view of a collapsible container in a collapsed configuration according to an embodiment of the present invention.
Figure 7:
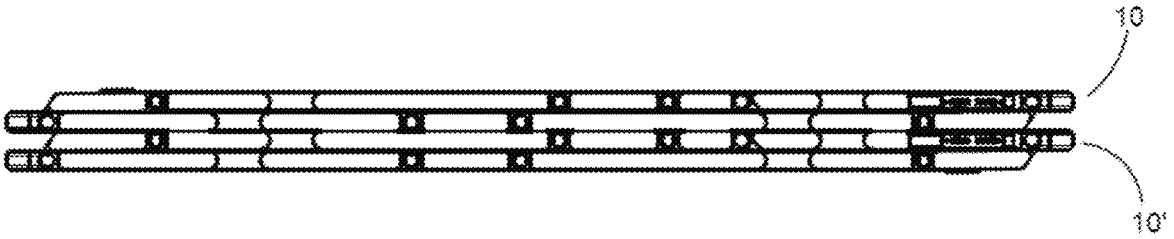
FIG. 7 is an elevation view of two collapsible containers in collapsed configurations and stacked according to an embodiment of the present invention.

As shown in FIGS. 5-7, collapsible container 10 is shown in a collapsed configuration. When collapsible container 10 is in a collapsed configuration, first fold-flat layer 40 and second fold-flat layer 50 are formed. First fold-flat layer 40 and second fold-flat layer 50 are positioned such that the footprint of collapsible container 10 is substantially the same as the footprint of first fold-flat layer 40 and second fold-flat layer 50. In this and other embodiments, first fold-flat layer 40 and second fold-flat layer 50 are connected at opposing ends of each layer by the opposing pair of dogleg panels 120*a*, 120*b*.

Figure 8A:
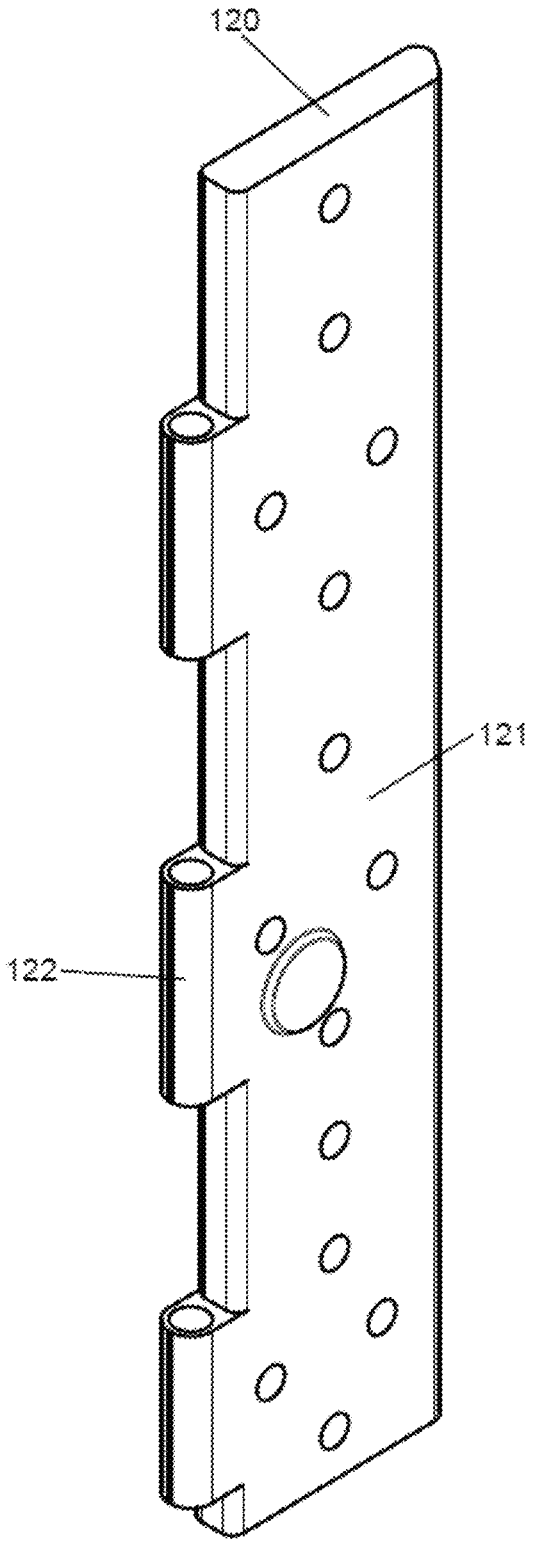
FIG. 8A is a perspective view of a dogleg panel according to an embodiment of the present invention.
Figure 8B:
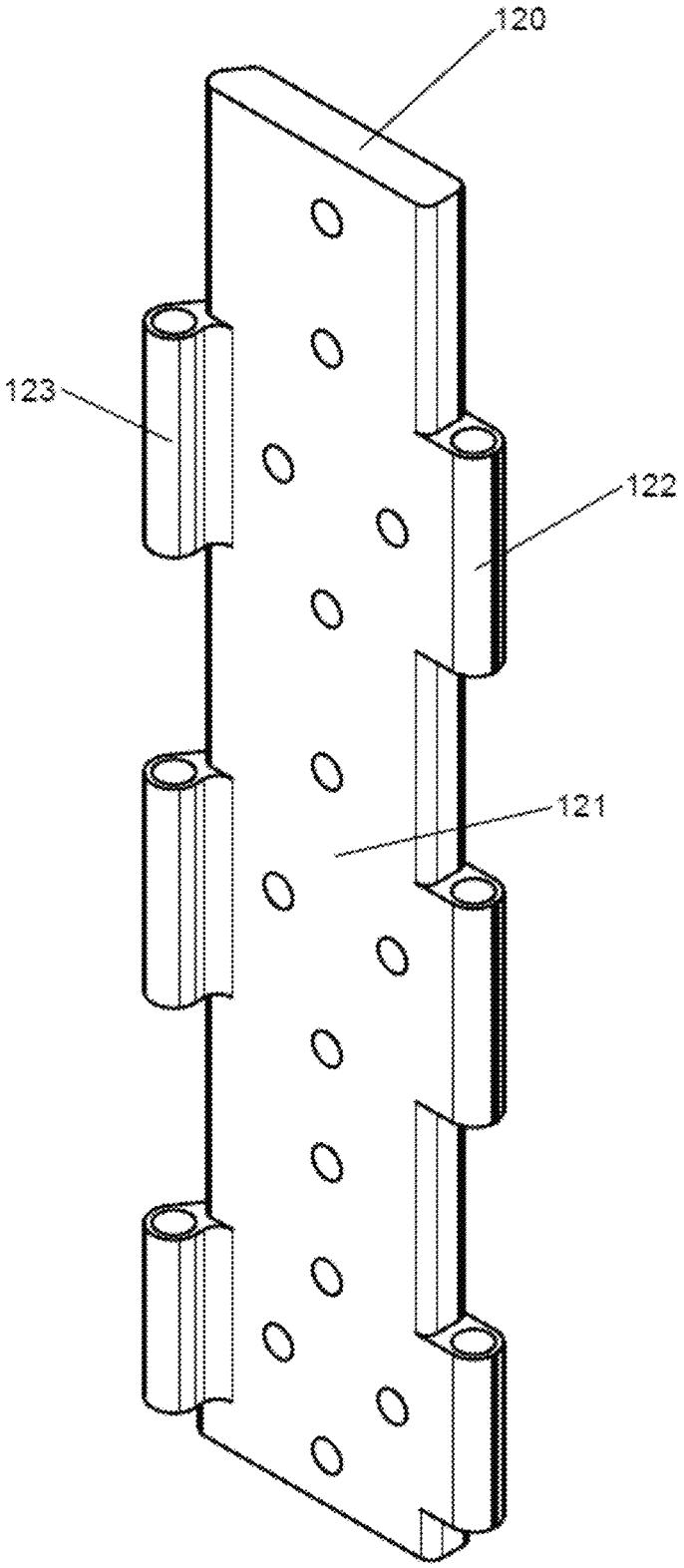
FIG. 8B is a perspective view of a dogleg panel according to an embodiment of the present invention.
Figure 8C:
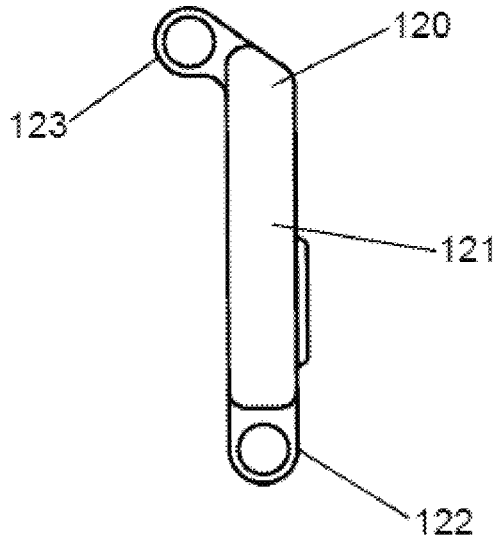
FIG. 8C is a plan view of a dogleg panel according to an embodiment of the present invention.

As shown in FIGS. 8A-8C, an exemplary dogleg panel 120 representative of each of the opposing pair of dogleg panels 120*a*, 120*b* is shown. Dogleg panel 120 includes body portion 121, hinge portion 122, and offset hinge portion 123. In this and other embodiments, offset hinge portion includes a plurality of bores formed within dogleg panel 120. Offset hinge portion 123 is configured such that it protrudes from body portion 121 to accommodate a thickness of first fold-flat layer 40 and a thickness of second fold-flat layer 50 such that fold-flat layers 40 and 50 are parallel and in contact with each other when collapsible container 10 is in the collapsed configuration. In these and other embodiments, accommodating the thickness of includes adjusting the offset angle of the offset hinge portion and adjusting the size of the offset hinge portion.

First fold-flat layer 40 comprises one dogleg panel 120*a* of the opposing pair of dogleg panels 120*a*, 120*b*, one side panel 150*a* of the opposing pair of side panels 150*a*, 150*b*, one corner panel 110*a* of the opposing pair of corner panels 110*a*, 110*b*, front panel 130, and offset hinge portion 123*b* of the other dogleg panel 120*b* of the opposing pair of dogleg panels 120*a*, 120*b*. Accordingly, at least some portion of each dogleg panel of the opposing pair of dogleg panels exists within each of the first fold-flat layer and the second fold-flat layer.

Second fold-flat layer 50 comprises the other dogleg panel 120*b* of the opposing pair of dogleg panels 120*a*, 120*b*, the other side panel 150*b* of the opposing pair of side panels 150*a*, 150*b*, the other corner panel 110*b* of the opposing pair of corner panels 110*a*, 110*b*, back panel 140, and offset hinge portion 123*a* of the one dogleg panel 120*a* of the opposing pair of dogleg panels 120*a*, 120*b*. Accordingly, at least some portion of each dogleg panel of the opposing pair of dogleg panels exists within each of the first fold-flat layer and the second fold-flat layer.

As evidenced by collapsible container 10 being shown in the erected and collapsed configurations, pivotal connection between each panel of the plurality of panels 20 is used to provide a container capable of switching between the two configurations without the need for any disassembly. Accordingly, a user of collapsible container 10 may very quickly erect collapsible container 10 for use and storage of materials as well as collapse collapsible container 10 for easy storage when use is no longer needed.

Figure 9:
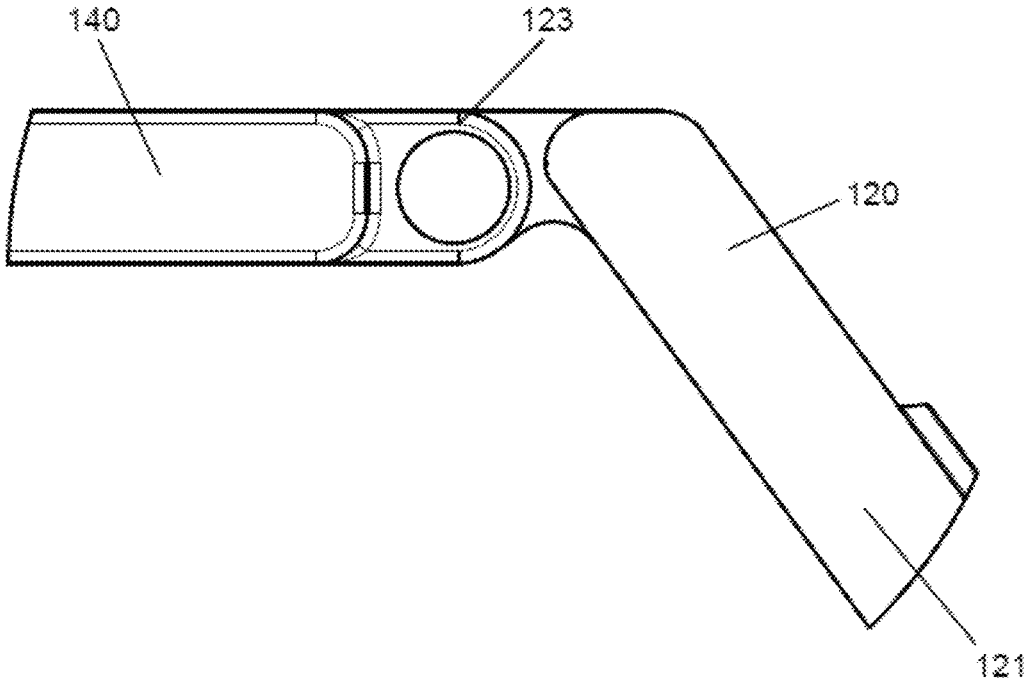
FIG. 9 is a plan view of a hinged connection of a collapsible container according to an embodiment of the present invention.

In some embodiments the pivotal connection is a hinged connection to provide for continuous connection between the plurality of panels when changing the collapsible container between the erected configuration and the collapsed configuration. As shown in FIG. 9, a top-down view of a connection between a dogleg panel 120 and back panel 140 is depicted. In this and other embodiments the hinged connection comprises a pin, not shown, within a bore of one or more hinge portions of each dogleg panel 120 and back panel 140. Further, as shown in FIG. 9, it is evident that dogleg panel 120 includes offset hinge portion 123 configured to accommodate the thickness of back panel 140 when folded together. In embodiments of the present invention where a hinged connection is used to join panels, the hinged connection may be described as a knuckle joint employing the use of bores and pins. Bores and pins suitable for use in the present invention may include threading or other features for securing pins within the bores while a collapsible container is assembled. Said threading or other fastening means may allow for flush mounting of pins at the hinged connection. Other suitable connections may include incorporating receipts and protuberances into the edges of each of the plurality of panels in a snap fit manner. Selection of the hinged connection can be made to simplify the manufacturing and assembly process of collapsible containers according to the present invention. In fact, an advantage of the present invention is the modularity provided by the plurality of panels with a simplified construction such that damaged or nonfunction parts may be readily replaced by the user.

In some embodiments, collapsible containers according to the present invention front panel 130, back panel 140, and side panels 150*a*, 150*b*, may all be the same. In these and other embodiments, a total of three unique panels are necessary to provide a collapsible container. The simplified design requiring only three unique types of panels advantageously streamlines manufacturing, assembly, and repair of the collapsible containers.

With reference to FIGS. 10-15, each panel of the plurality of panels 20 is further described. Generally, panels suitable for use in the present invention may be described as planar bodies including first and second major surfaces which function as the interior and exterior surfaces. Said panels may be further described as having hinge portions at the edges of said planar bodies with at least two hinge portions on opposite edges of the planar bodies. Each panel of the plurality of panels may further include other features including but not limited indentations for displaying labels in set orientation, slots within the top edge of the panel to accommodate lifting devices including forklifts and cranes, slots for aiding in the erection of the collapsible container from the collapsed configuration, slots for viewing the level of the material contained within the collapsible container, features to strengthen the panel including kiss-offs, male and female indentations and protrusions to aid in panel alignment when stacking more than one collapsible container in the collapsed position, and features for mounting a dust lid to the top of the collapsible container. Kiss-offs may be generally understood as ribs produced to bridge the gap between the male and female parts of a rotational mold. Kiss-offs advantageously may provide added strength, stiffness, or rigidity to panels suitable for use in the present invention. These features and others are discussed below.

In some embodiments, in the collapsed configuration the slots/cut-out(s) in a first fold-flat layer overlap with a non-cut-off portion of panels in the second fold-flat layer and vice versa to provide hand access so user can grab panels and move to erected configuration.

Figure 10:
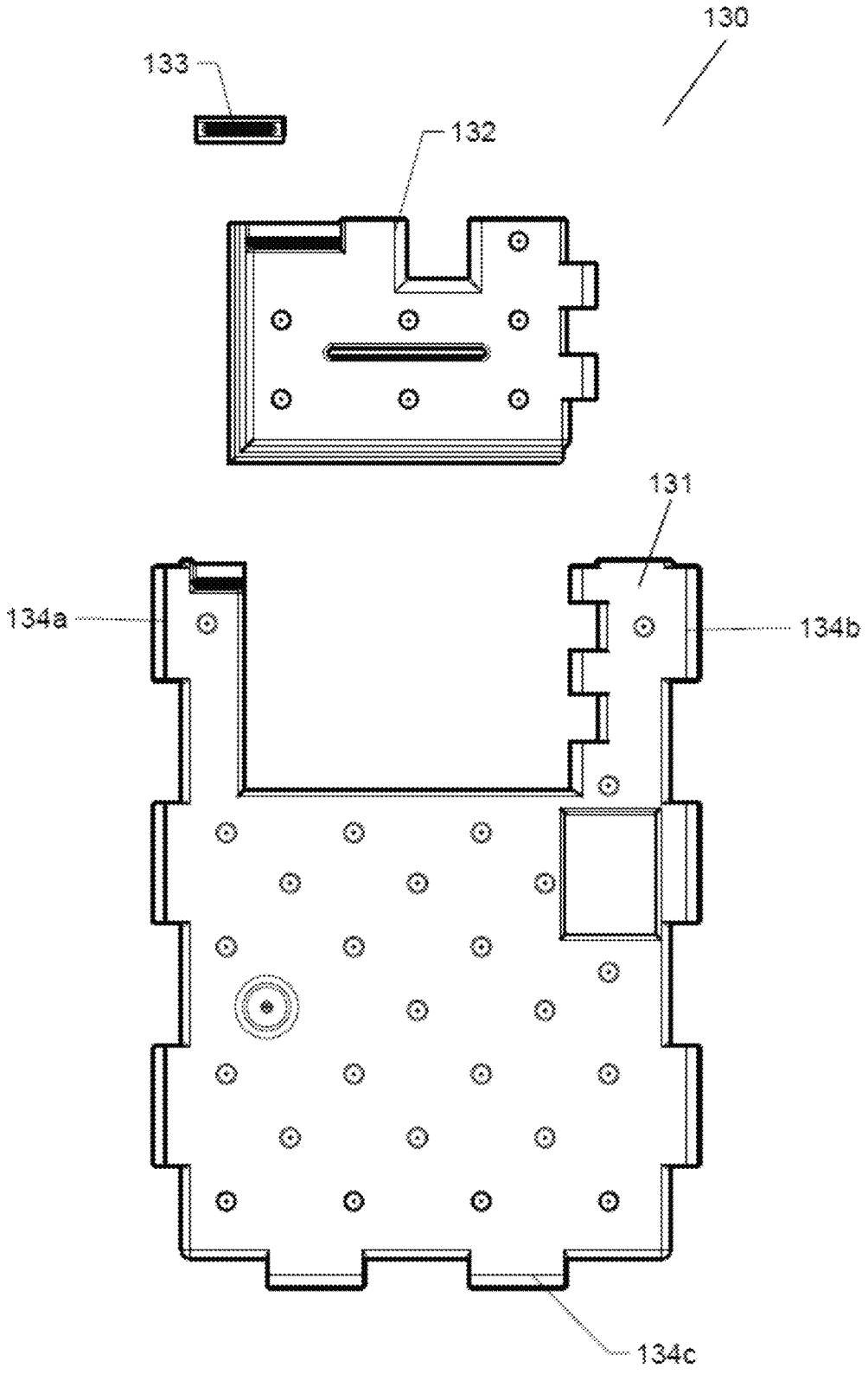
FIG. 10 is an exploded elevation view of a front panel according an embodiment of the present invention.

As shown in FIG. 10, front panel 130 is shown including front panel body 131, front panel door 132, and front panel door latch 133. When collapsible container 10 is filled with material, front panel door latch 133 may be manipulated to allow for front panel door 132 to open to provide improved access to the material stored within collapsible container 10. Front panel door 132 may open inward or outward. Front panel door latch 133 is configured to secure front panel door 132 unless acted on by a user. In this and other embodiments, front panel door latch 133 is a slidable latch mounted to a track formed in front panel body 131 and front panel door 132. Front panel body 131 includes hinge portions 134*a*, 134*b*, 134*c* formed in the side edges and bottom edge. As discussed above, hinge portions 134*a*, 134*b* are pivotally connected to other panels of the plurality of panels.

Figure 11:
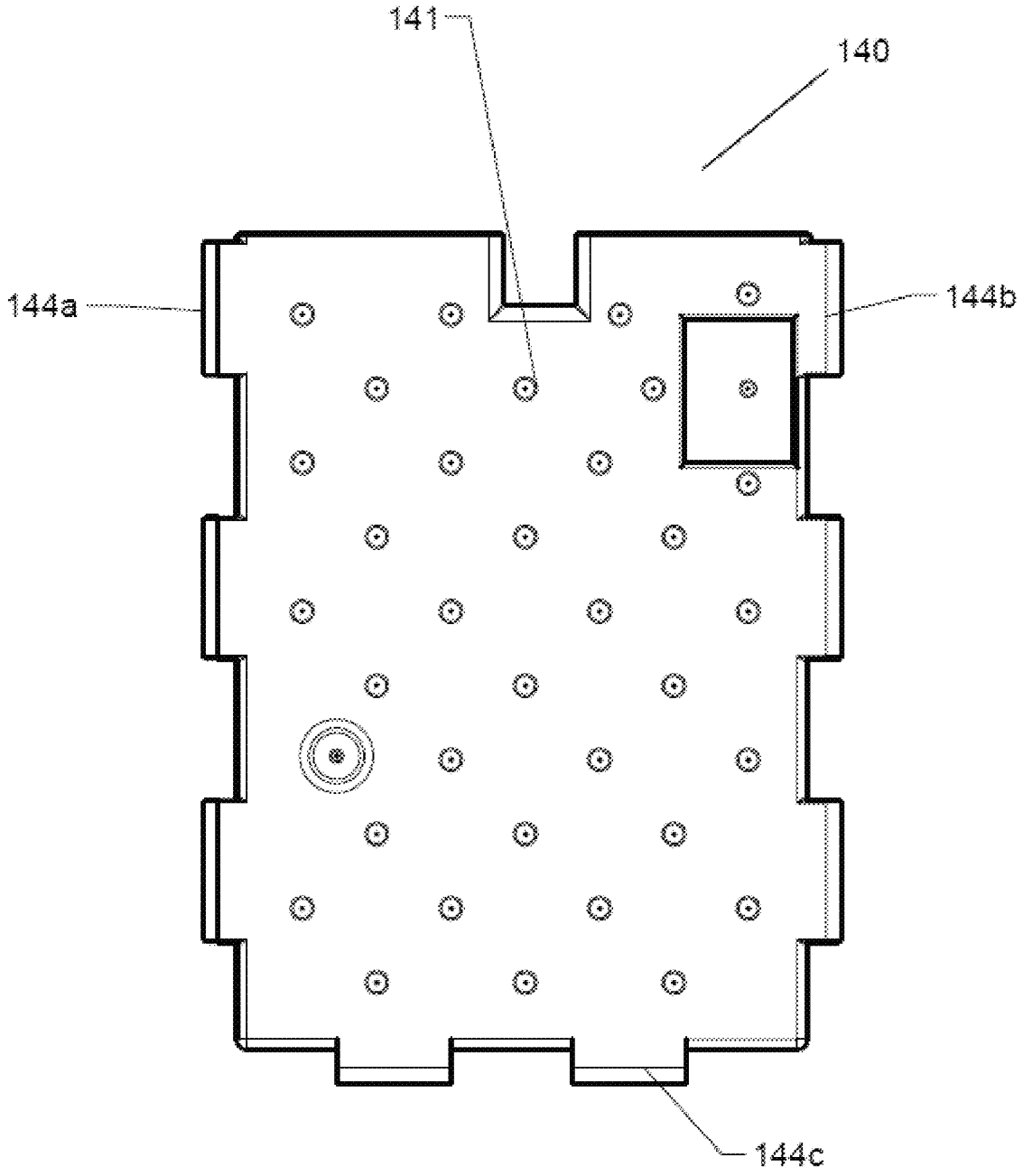
FIG. 11 is an elevation view of a back panel according an embodiment of the present invention.

As shown in FIG. 11, back panel 140 includes back panel body 141 and hinge portions 144*a*, 144*b*, 144*c* formed in the side edges and bottom edge. As discussed above, hinge portions 144*a*, 144*b* are pivotally connected to other panels of the plurality of panels.

Figure 12:
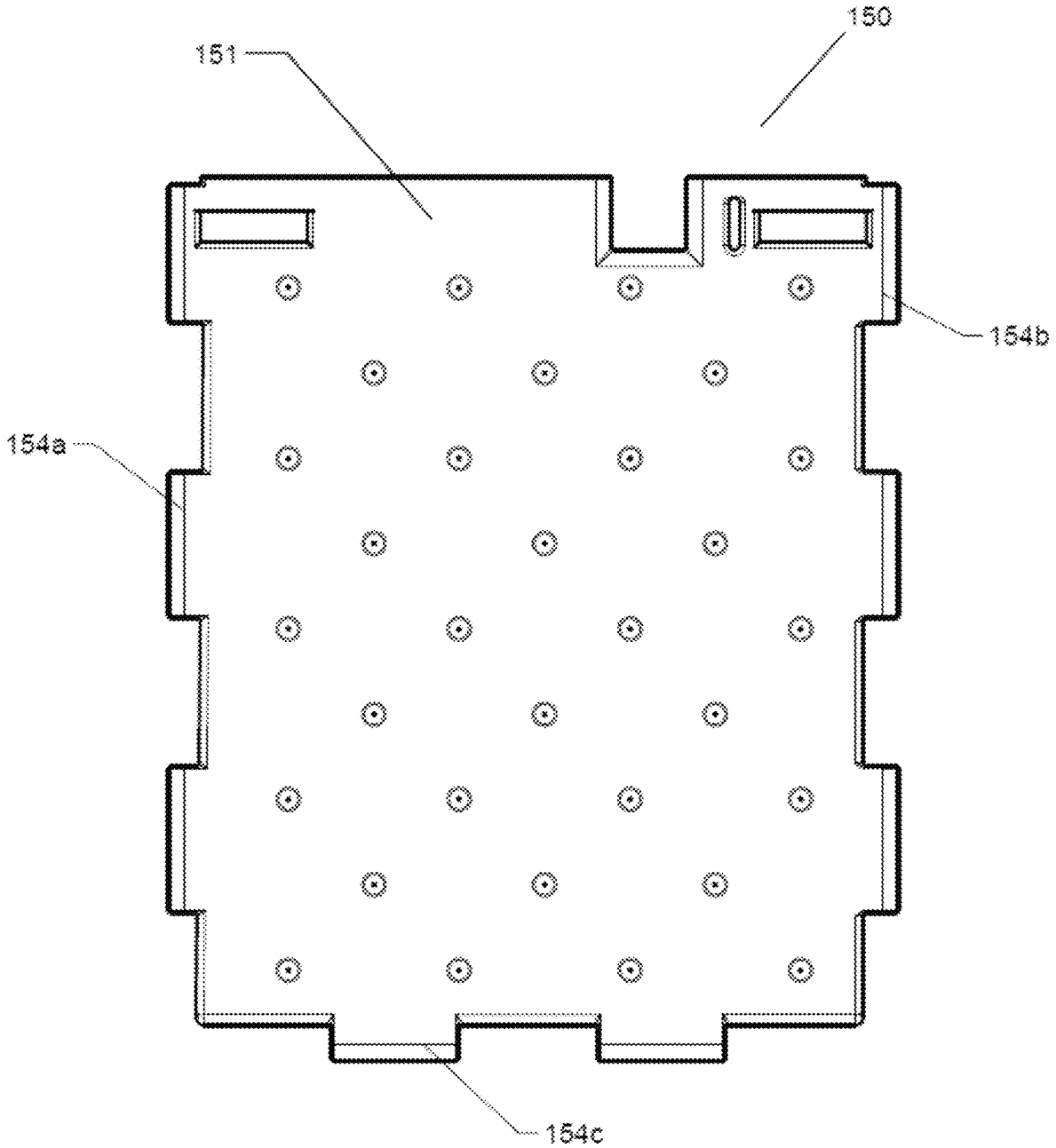
FIG. 12 is an elevation view of a side panel according an embodiment of the present invention.

As shown in FIG. 12, side panel 150 includes side panel body 151 and hinge portions 154*a*, 154*b*, 154*c* formed in the side edges and bottom edge. As discussed above, hinge portions 154*a*, 154*b* are pivotally connected to other panels of the plurality of panels.

Figure 13A:
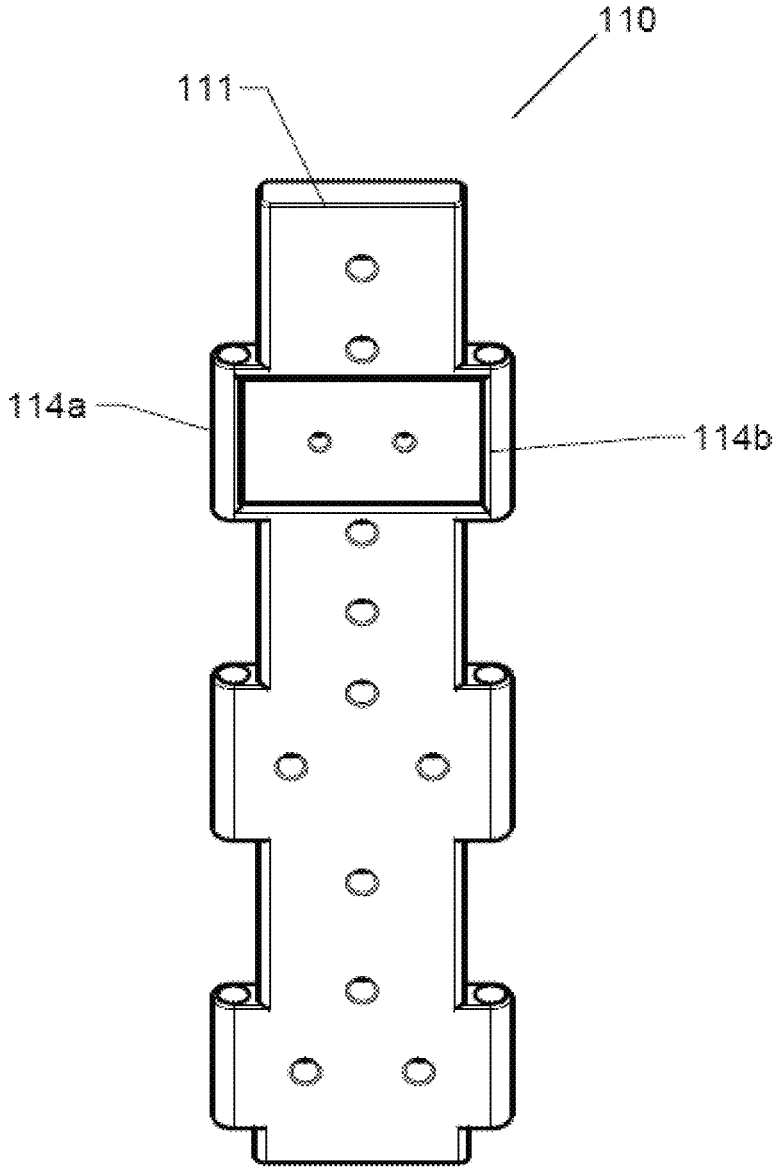
FIG. 13A is a perspective view of a corner panel according an embodiment of the present invention.
Figure 13B:
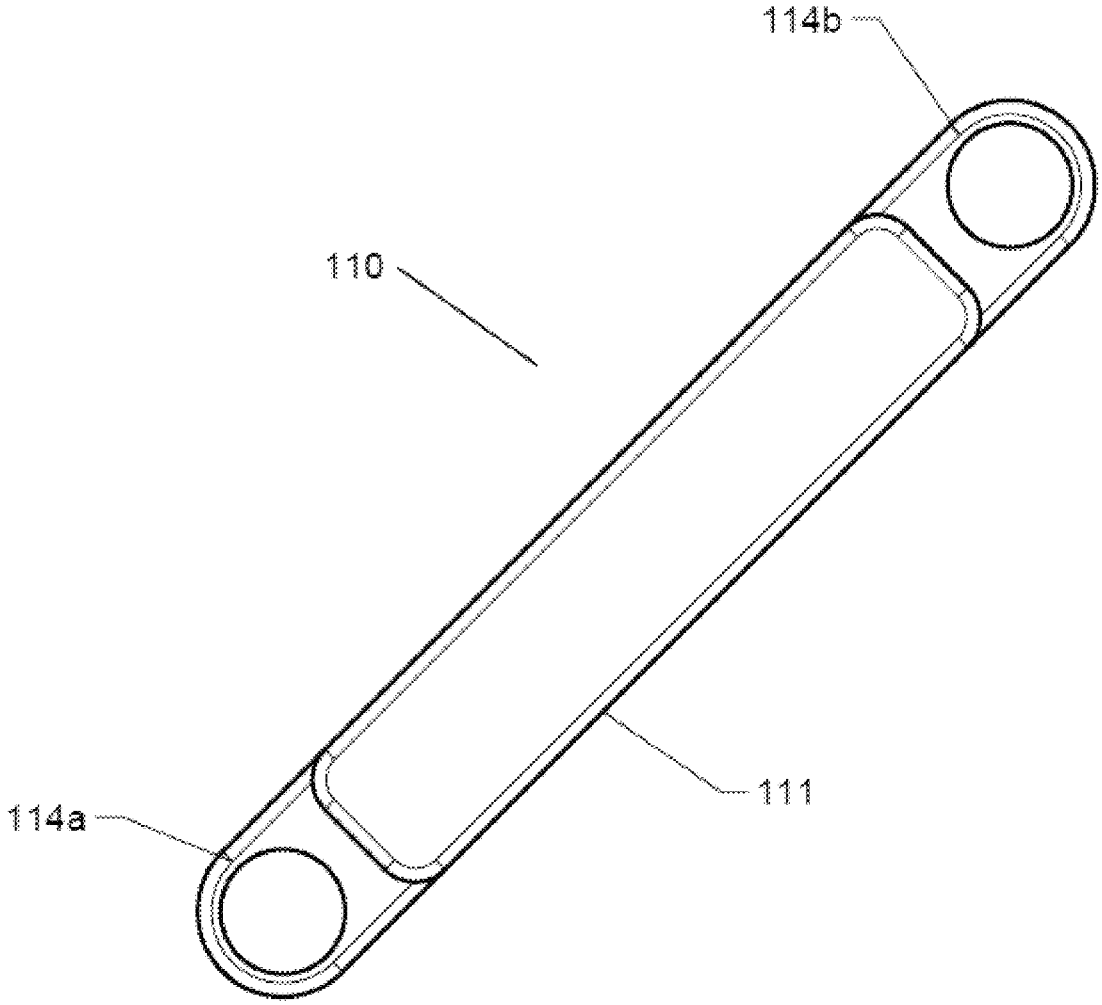
FIG. 13B is a plan view of a corner panel according an embodiment of the present invention.

As shown in FIGS. 13A and 13B, corner panel 110 of the opposing pair of corner panels 110*a*, 110*b* includes corner panel body 111 and hinge portions 114*a*, 114*b* formed in the side edges. As discussed above, hinge portions 154*a*, 154*b* are pivotally connected to other panels of the plurality of panels.

Figure 14:
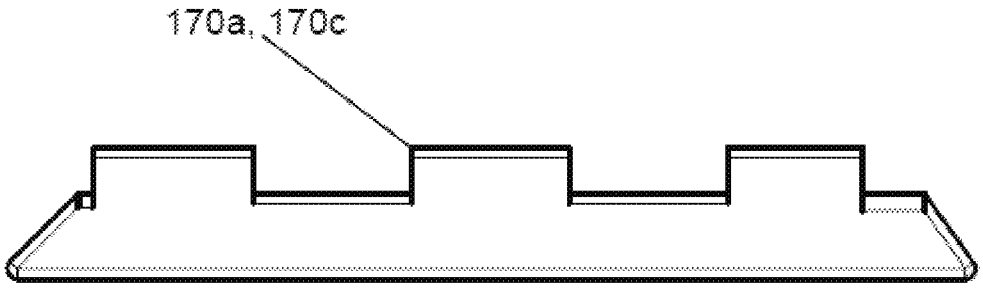
FIG. 14 is an elevation view of a bottom perimeter flap according an embodiment of the present invention.
Figure 15:
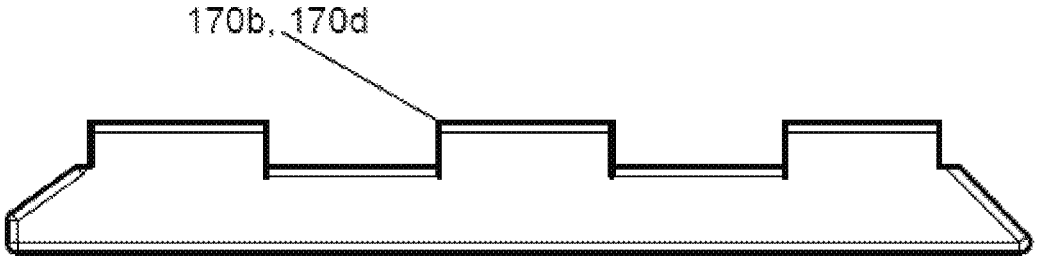
FIG. 15 is an elevation view of a bottom perimeter flap according an embodiment of the present invention.
Figure 16:
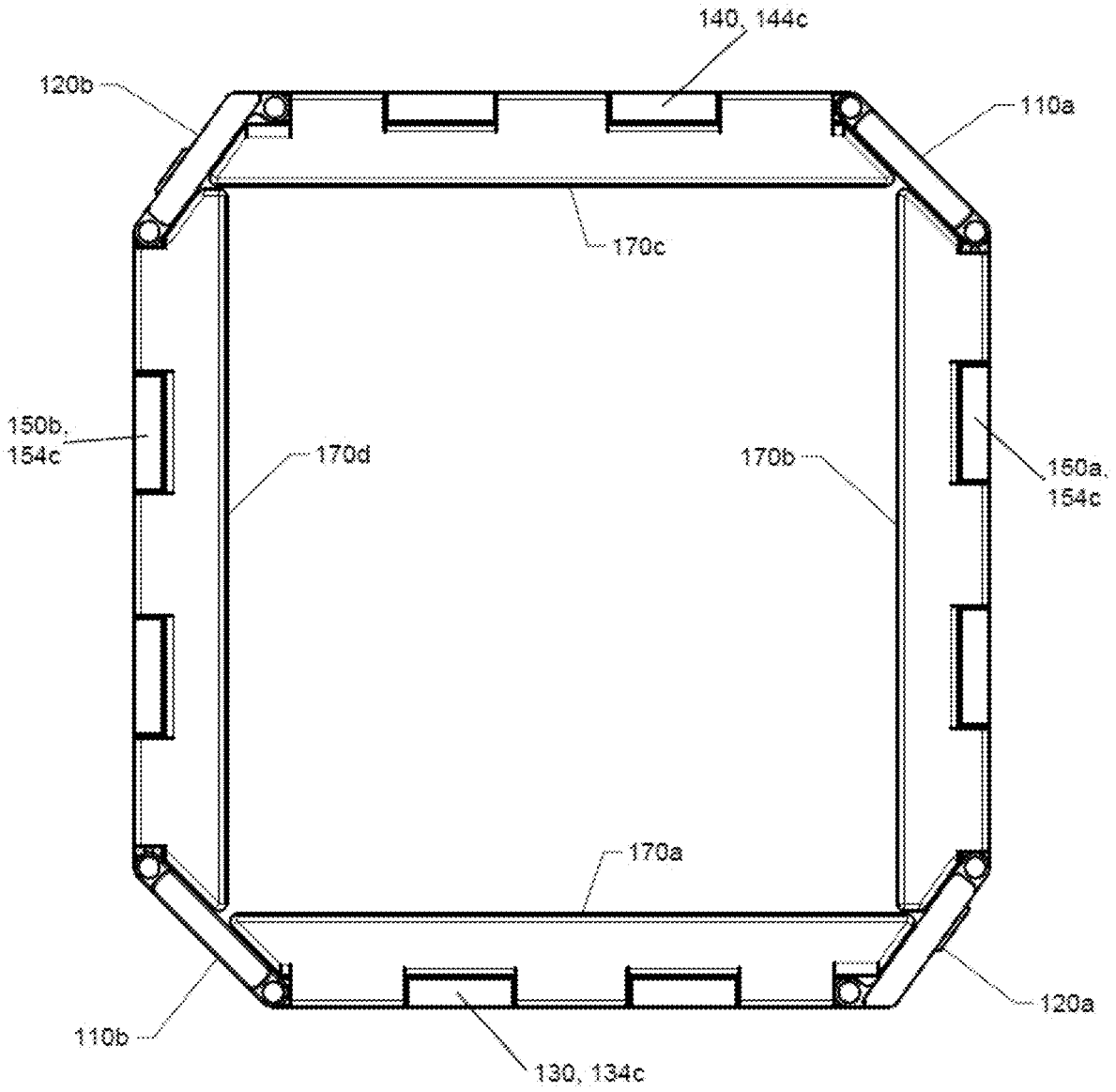
FIG. 16 is a bottom-up plan view of a collapsible container according an embodiment of the present invention.

As shown in FIGS. 14-16, collapsible container 10 may further include a plurality of bottom perimeter flaps 170*a*, 170*b*, 170*c*, 170*d*. In such embodiments, each of the plurality of bottom perimeter flaps present is pivotably connected to one of front panel 130, back panel 140, and opposing pair of side panels 150*a*, 150*b*. Bottom perimeter flaps 170*a*, 170*b*, 170*c*, 170*d* are configured such that they interfere with an adjacent bottom perimeter flap if present. This interference configuration frustrates the collapsible container from collapsing out of the erected configuration. For example, only two neighboring bottom perimeter flaps are necessary, as their interference would still frustrate the collapsing of the entirety. Accordingly, each bottom perimeter flap of the plurality of bottom perimeter flaps is configured to provide an interference fit with one or more adjacent bottom flaps in the erected configuration. The bottom perimeter flaps may further provide a stable base for collapsible container 10, when collapsible container 10 is placed upon a surface.

As shown in FIG. 15, plurality of bottom perimeter flaps 170*a*, 170*b*, 170*c*, 170*d* are included in collapsible container 10, with bottom perimeter flap 170*a* being pivotally connected to front panel 130, bottom perimeter flap 170*b* being pivotally connected to back panel 140, bottom perimeter flaps 170*c*, 170*d* each being pivotally connected to one of each of the pair of opposing side panels 150*a*, 150*b*. In this embodiment, the interference fit and stability provided by plurality of bottom perimeter flaps 170*a*, 170*b*, 170*c*, 170*d* enhances the rigidity of collapsible container 10. Plurality of bottom perimeter flaps 170*a*, 170*b*, 170*c*, 170*d* are pivoted to be perpendicular to the plurality of panels in the erected configuration. Each bottom perimeter flap of the plurality of bottom perimeter flaps 170*a*, 170*b*, 170*c*, 170*d* are configured to be coplanar with each panel of the plurality of panels when the collapsible container is in the collapsed configuration.

In some embodiments a dust lid is placed on top of the collapsible container. In some embodiments, the dust lid may be pivotally connected such that it may be lifted or closed. In other embodiments, the dust lid may be snap fit to the plurality of panels to be held in place, with access to material being provided through doors in the panels.

In some embodiments, panels of the plurality of panels are made from wood, metal, plastic.

In some embodiments, dimensions of each panel of the plurality of panels and thus collapsible container are sized according to the type of use or application. In some embodiments, collapsible containers are sized to fit on a standard pallet. In other embodiments, collapsible containers are sized to fit multiple containers on a standard pallet. In some embodiments the thickness of each panel of the plurality of panels is sized according to the strength required for a given application. Generally, the strength of the collapsible container may be increased by increasing the thickness of the panels used.

In some embodiments, collapsible containers according to the present invention may contain more than 500 lbs of material. In other embodiments, 750 lbs of material. In other embodiments, 1000 lbs of material. In other embodiments, 1250 lbs of material. In other embodiments, 1500 lbs of material. In other embodiments, 1750 lbs of material. In other embodiments, 2000 lbs of material.

In some embodiments, collapsible containers according to the present invention may be stacked upon each other. In these and other embodiments, stacking two or more collapsible containers may include placing a pallet between the bottom collapsible container and the one or more stacked collapsible container(s).

In light of the foregoing, it should be appreciated that the present invention significantly advances the art by providing a collapsible container that is structurally and functionally improved in a number of ways. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A collapsible container comprising:

a plurality of separable panels including:

an opposing pair of corner panels;

an opposing pair of dogleg panels, wherein each dogleg panel of the opposing pair of dogleg panels includes an offset hinge portion and a hinge portion;

a front panel opposed from a back panel; and an opposing pair of side panels;

wherein each of the front panel, the back panel, and the opposing pair of side panels have a pivotal connection to one corner panel of the opposing pair of corner panels and one dogleg panel of the opposing pair of dogleg corner panels, and wherein the pivotal connection between each panel of the plurality of separable panels is a hinged connection; and wherein the collapsible container has an erected configuration and a collapsed configuration.

2. The collapsible container of claim 1, wherein the opposing pair of corner panels, the opposing pair of dogleg panels, the front panel, the back panel, and the opposing pair of side panels form a plurality of sidewalls of the collapsible container in the erected configuration, and wherein, when the plurality of sidewalls are oriented generally upwardly from a surface, the plurality of sidewalls and said surface define a container volume.

3. The collapsible container of claim 2, wherein the surface is provided by a pallet, wherein the pallet provides a bottom surface having slots.

4. The collapsible container of claim 3, wherein a bottom surface insert is placed on the surface to form a continuous surface over the pallet.

5. The collapsible container of claim 1, wherein when the collapsible container is in the erected configuration the front panel forms a first plane that is parallel to a second plane formed by the back panel, wherein a third plane and a fourth plane are formed by each one of the opposing pair of side panels, wherein the third plane is parallel to the fourth plane, and wherein the first plane and second plane are perpendicular to the third plane and fourth plane.

6. The collapsible container of claim 1, wherein when the collapsible container is in the collapsed configuration a first fold-flat layer and a second fold-flat layer are formed, and wherein the first fold-flat layer and the second fold-flat layer are positioned such that a footprint of the collapsible container in the collapsed configuration is substantially the same as a footprint of the first fold-flat layer and a footprint of the second fold-flat layer.

7. The collapsible container of claim 6, wherein the first fold-flat layer and the second fold-flat layer are joined at opposing ends by the opposing pair of dogleg panels.

8. The collapsible container of claim 7, wherein the first fold-flat layer comprises one dogleg panel of the opposing pair of dogleg panels, one side panel of the opposing pair of side panels, one corner panel of the opposing pair of corner panels, the front panel, and the offset hinge portion of the other dogleg panel of the opposing pair of dogleg panels.

9. The collapsible container of claim 8, wherein the second fold-flat layer comprises the other dogleg panel of the opposing pair of dogleg panels, the other side panel of the opposing pair of side panels, the other corner panel of the opposing pair of corner panels, the back panel, and an offset hinge portion of the one dogleg panel of the opposing pair of dogleg panels.

10. The collapsible container of claim 1, wherein each of the hinged connections provides for continuous connection between the plurality of separable panels when changing the collapsible container between the erected configuration and the collapsed configuration.

11. The collapsible container of claim 1, wherein each of the hinged comprises a pin within a bore of one or more female hinge portions formed in each panel of the plurality of separable panels.

12. The collapsible container of claim 11, wherein the one or more female hinge portions are located on opposing edges of each panel of the plurality of separable panels.

13. The collapsible container of claim 9, wherein the offset hinge portion of each dogleg panel of the opposing pair of dogleg panels is configured to accommodate a thickness of the first fold-flat layer and a thickness of the second fold-flat layer.

14. The collapsible container of claim 2, further comprising a plurality of bottom perimeter flaps, and wherein one of the plurality of bottom perimeter flaps is pivotably connected to each of the front panel, the back panel, and the opposing pair of side panels.

15. The collapsible container of claim 14, wherein when the collapsible container is in the erected configuration the plurality of bottom perimeter flaps is pivoted to be perpendicular to the plurality of separable panels.

16. The collapsible container of claim 15, wherein each bottom perimeter flap of the plurality of bottom perimeter flaps is configured to provide an interference fit with one or more adjacent bottom perimeter flaps in the erected configuration.

17. The collapsible container of claim 16, wherein each bottom perimeter flap of the plurality of bottom perimeter flaps is configured to be coplanar with each panel of the plurality of separable panels the bottom perimeter flap is pivotally connected to when the collapsible container is in the collapsed configuration.

18. The collapsible container of claim 17, wherein the plurality of bottom perimeter flaps comprises a front panel bottom perimeter flap pivotally connected to the front panel, a back panel bottom perimeter flap pivotally connected to the front panel, a pair of side panel bottom perimeter flaps pivotally, one of each of the pair of side panel bottom perimeter flaps connected to one of each side panel of the opposing pair of side panels.

19. The collapsible container of claim 1, wherein the front panel comprises a front panel door and a front panel door latch.

20. A collapsible container comprising:

a plurality of separable panels including:

an opposing pair of corner panels;

an opposing pair of dogleg panels;

a front panel opposed from a back panel; and an opposing pair of side panels;

wherein each of the front panel, the back panel, and the opposing pair of side panels have a pivotal connection to one corner panel of the opposing pair of corner panels and one dogleg panel of the opposing pair of dogleg corner panels, wherein the pivotal connection between each panel of the plurality of separable panels is a hinged connection, and wherein each panel of the plurality of separable panels comprises a non-corrugated material; and wherein the collapsible container has an erected configuration and a collapsed configuration.

* * * * *